US005564991A

United States Patent [19]

Hirose

[11] Patent Number: 5,564,991

[45] Date of Patent: Oct. 15, 1996

[54] GOLF CLUB

[76] Inventor: Tokuzo Hirose, 13-13, Higashiyama-cho, Ashiya-shi, Hyogo, Japan

[21] Appl. No.: 530,568

[22] Filed: Sep. 20, 1995

[51] Int. Cl.[6] ..... A63B 53/04

[52] U.S. Cl. ..... 473/328; 473/327; 473/330

[58] Field of Search ..... 273/167 A, 167 J, 273/167 B, 174, 172, 167 E; 473/324, 327, 328, 330

[56] References Cited

U.S. PATENT DOCUMENTS

| | | | |
|---|---|---|---|
| 1,505,296 | 8/1924 | Smith | 273/167 A |
| 3,862,759 | 1/1975 | Evans et al. | 273/167 A |
| 5,301,944 | 4/1994 | Koehler | 273/167 A |

OTHER PUBLICATIONS

"The Search For A Perfect Swing", J. B. Lippincott Company, Philadelphia and New York, 1968.

*Primary Examiner*—George J. Marlo
*Attorney, Agent, or Firm*—Iandiorio & Teska

[57] ABSTRACT

It is an object to provide a golf club comprising a head including a face having a loft angle of 70 to 90 degrees. Preferably, grooves are formed in the face of a head in the longitudinal direction of the face, and the back surface of the head has a slowly bulgy form or grooves are formed on the back surface of the head in the transverse direction of the back surface. Since the loft angle is 70 to 90 degrees, it is possible to loft up a ball almost directly overhead.

1 Claim, 9 Drawing Sheets

PRIOR ART

GOLF CLUB

BACKGROUND OF THE INVENTION

1. Field of the Invention

The invention relates to a golf club, and particularly, to a sand wedge and a pitching wedge.

2. Description of the Related Art

FIG. 13 is a side view showing a typical prior art golf club and FIG. 14 is a front view of a golf club 1 of FIG. 13. Conventionally, the golf club 1 includes a straight shaft 2 which is made of iron or carbon fiber, a grip 3 attached to one end of the shaft 2 to hold the golf club 1, and a head 4 made of metal which is fixed to the other end of the shaft 2. A face 6, a hitting face, is formed in the head 4. A plurality of grooves 7 called grooving are formed in the face 6 in the longitudinal direction thereof, namely the right and left direction of FIG. 14. The face 6 forms a loft angle θ1 with an axis 7 of the shaft 2. The loft angle θ1 is determined in accordance with a distance to be taken when hitting a ball 5. The golf club called sand wedge has the largest loft angle θ1 of 55 to 60 degrees.

According to the prior art, when the ground immediately in front of the ball in a direction at which the ball is aimed rises almost perpendicularly in a low spot called "a guard bunker," or when the ball should be aimed over an obstacle such as tall trees, it is desirable to hit the ball 5 approximately at a right angle. Hence, when the loft angle θ1 is 55 to 60 degrees, the ball cannot easily fly over the obstacle, and as a result the game is put into a so-called unplayable state wherein a player cannot play the game anymore.

SUMMARY OF THE INVENTION

Accordingly, it is an object of the invention to provide a golf club with which it is possible to hit a ball high almost perpendicularly to the ground so that the ball easily flies over a tall obstacle.

A golf club of the invention comprises a head including a face having a loft angle of 70 to 90 degrees.

Further a golf club of the invention comprises a head including a face having a loft angle of 70 to 90 degrees, wherein grooves called grooving are formed in the face in the longitudinal direction thereof.

Further a golf club of the invention comprises a head including a face having a loft angle of 70 to 90 degrees, wherein the back surface of the head has a softly bulgy form.

Still further, a golf club of the invention comprises a head including a face having a loft angle of 70 to 90 degrees, wherein grooves are formed in the back surface of the head in the transverse direction of the back surface.

According to the invention, the loft angle of the face is 70 to 90 degrees, it is possible to hit a ball on high almost perpendicularly to the ground, so that the ball can easily fly over a tall obstacle.

Further, according to the invention, the grooves called grooving are formed in the face in the longitudinal direction thereof, so that the ball is reversely spun when being hit and is prevented from rolling.

Still further, according to the invention, the back surface of the head has a softly bulgy form, so that the face can easily scoop the ball which is partially buried in a ground when the ball is to be hit on a relatively soft ground such as a sand ground. This allows the face to hit the ball at a lower portion of the ball. Therefore, it is possible to easily hit the ball almost perpendicularly to the ground.

Yet further, according to the invention, since the grooves are formed in the back surface of the head in the transverse direction of the back surface so that sand falls off through the grooves, even the ball on a sand ground can be hit without the loss of hitting force by sand.

According to the invention, since the loft angle is 70 to 90 degrees, it is possible to hit a ball high almost perpendicularly to the ground. Consequently the ball will easily fly over an obstacle which is located immediately in front of the ball.

Further, according to the invention, the grooves called grooving are formed in the face in the longitudinal direction thereof, so that the ball is reversely spun when being hit, and prevented from rolling. Such prevention of rolling, namely stopping the ball at a landing point, is advantageous because the golf club is used near a putting green.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
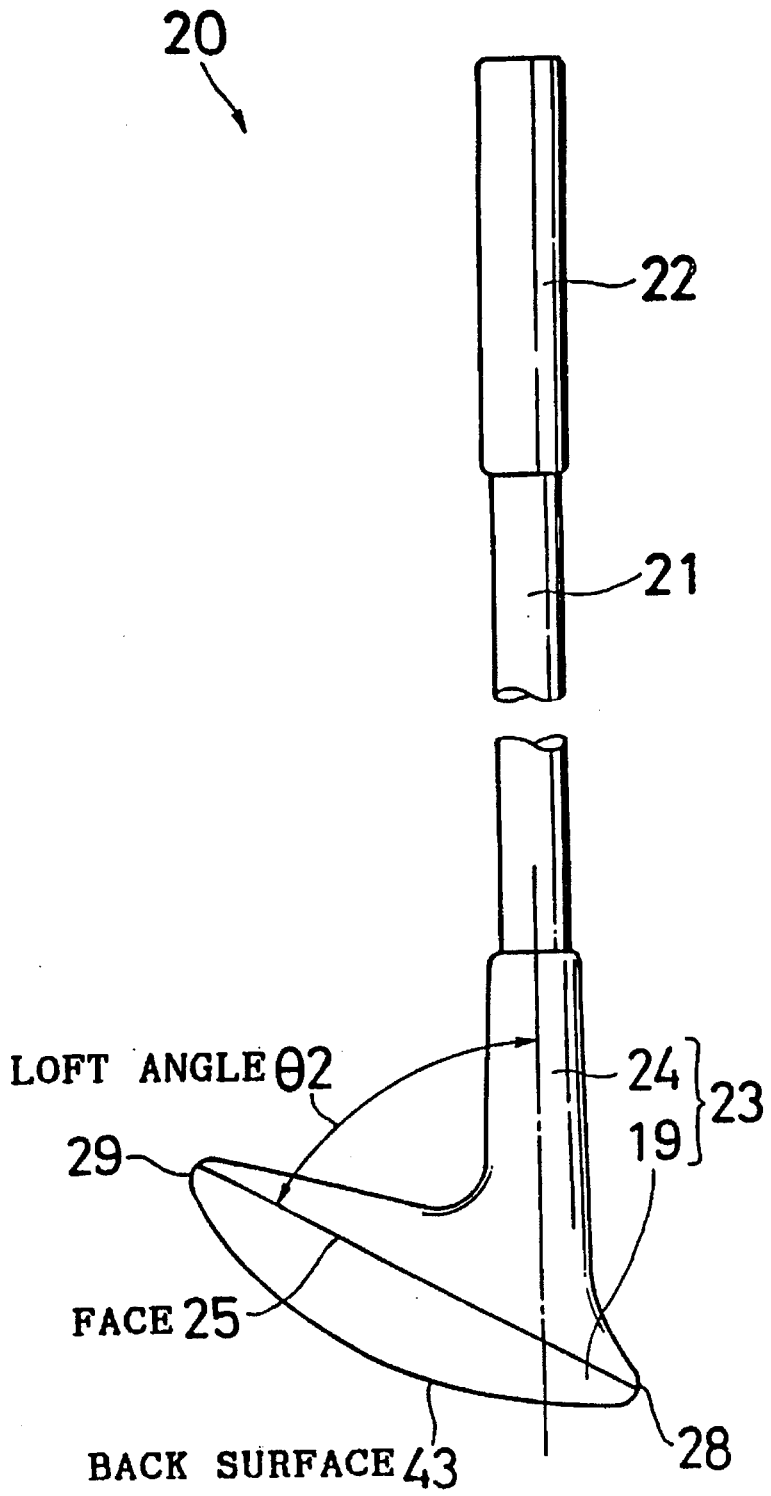
FIG. 1 is a side view of a golf club 20 of an embodiment of the invention.

Now referring to the drawings, preferred embodiments of the invention are described below.

Figure 2:
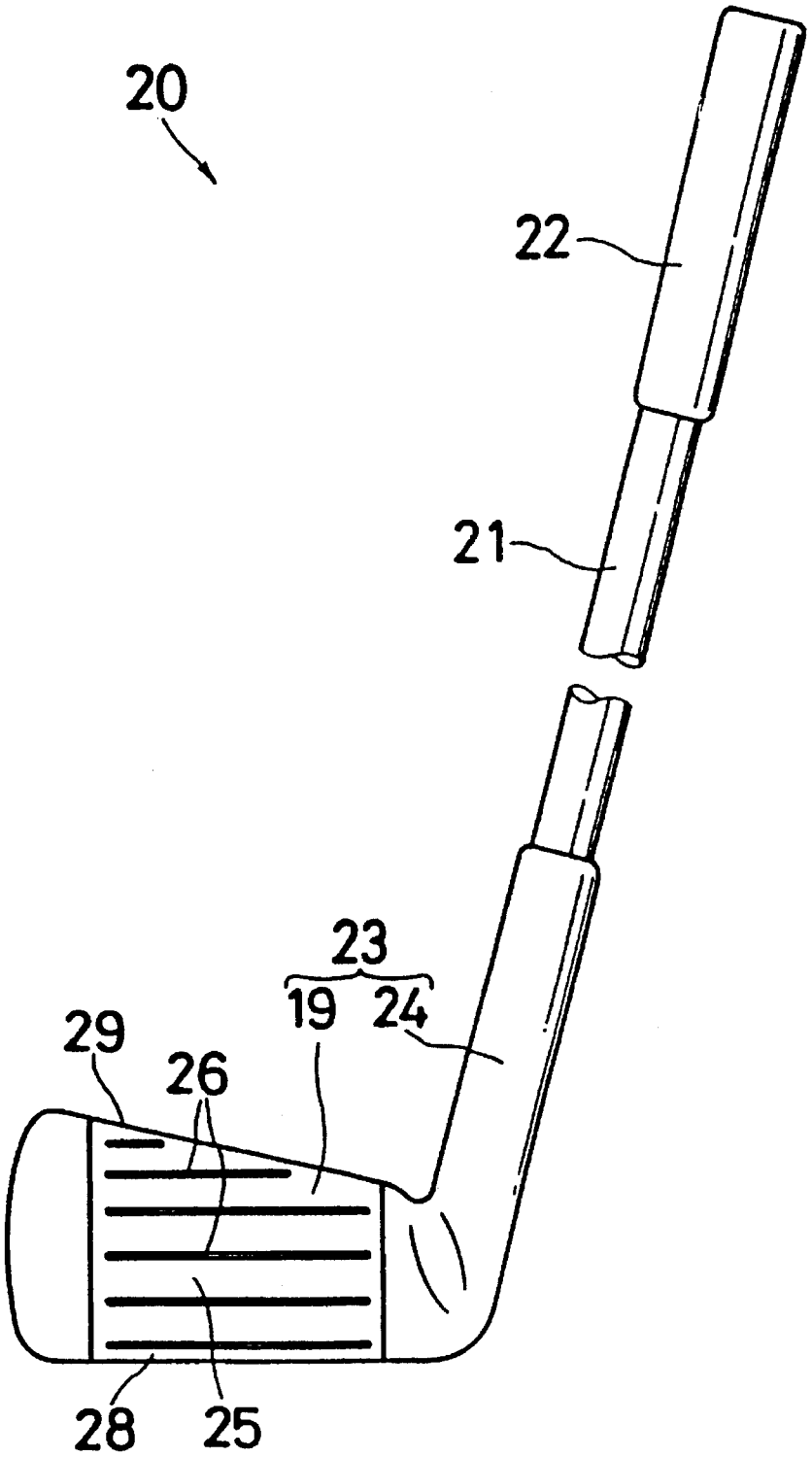
FIG. 2 is a front view of the golf club 20 of FIG. 1.

FIG. 1 is a side view of an embodiment of the invention, and FIG. 2 is a front view of a golf club 20 of FIG. 1. The golf club 20, which is often called, for example, sand wedge, comprises a straight shaft 21 made of iron, carbon fiber or the like and a grip 22 attached to one end of the shaft 21. A head 23 made of metal is attached to the other end of the shaft 21. The head 23 includes a hosel 24 fixed to the shaft 21 and a blade 19 integrated with the hosel 24. A flat face 25 is formed in the blade 19. Grooves 26 parallel to each other, which are called grooving, are formed in the face 25. The loft angle θ2 formed by the face 25 and the axis 27 of the shaft 22 selected to be 70 to 90 . A forefront portion 28 and an rearmost portion 29 of the head 23 are formed in a loose arc shape, and thereby, even when a person hits himself or another person with the front portion 28 or the rear portion 29 in hitting a ball, neither the front portion 28 nor the aftermost portion 29 easily injures the persons.

Figure 3A:
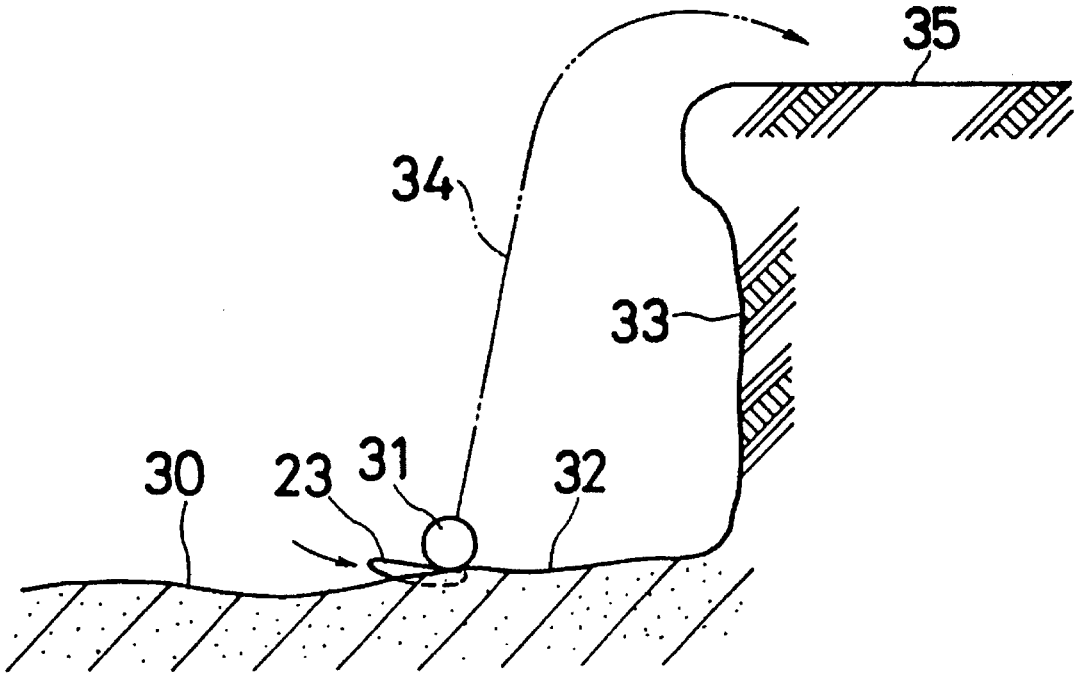
FIGS. 3A and 3B are views showing a behavior of a ball 31 which is hit upward with the golf club 20.

FIG. 3A is a cross sectional view showing a state of a ball 31 which dropped into a low spot 30, which is, for example, a sand ground. Even though the ball 31 on an almost flat bottom ground surface 32 is closely faced with an elevating ground 33, since the face 25 has an arc-formed back surface 43 which is slightly swollen (or bulgy), the ball can be easily hit onto a ground surface 35 as shown by an imaginary line 34, when being hit with the golf club 20.

Figure 3B:
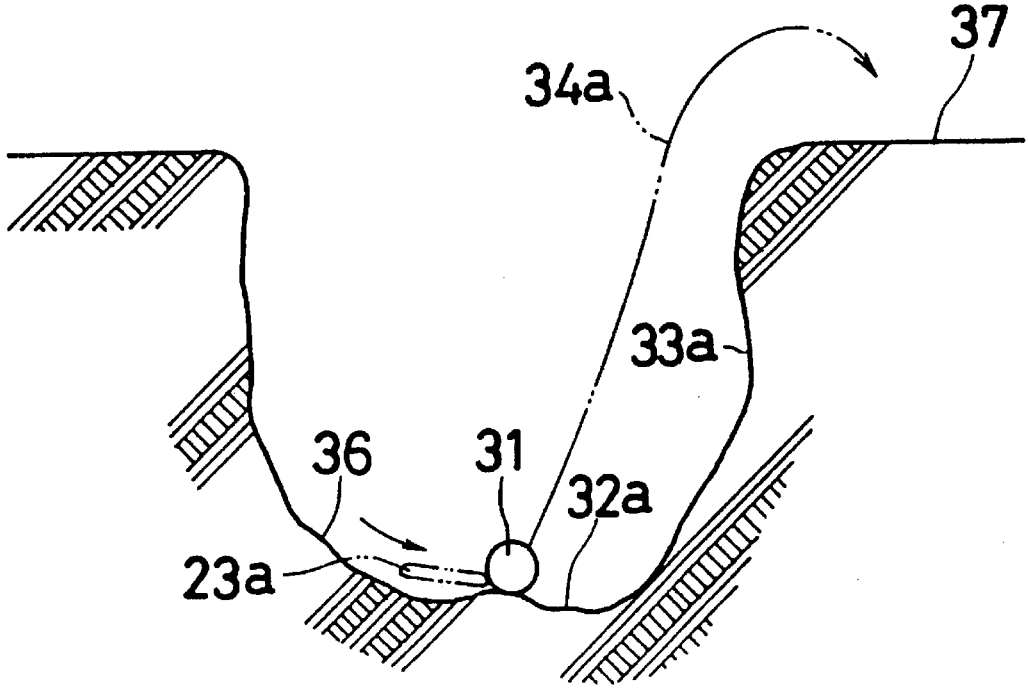

Further, as shown in FIG. 3B, even when the ball 31 drops on a bottom ground surface 32a of a low spot 36 which is not a sand ground, by hitting the ball 31 with a head 23*a* of the golf club 20 at a lower portion of the ball 31, it is possible to loft up the ball 31 almost perpendicularly to the ground as shown by an imaginary line 34*a*. The ball 31 is easily hit out onto a ground surface 37, a player can continue a game.

Figure 4A:
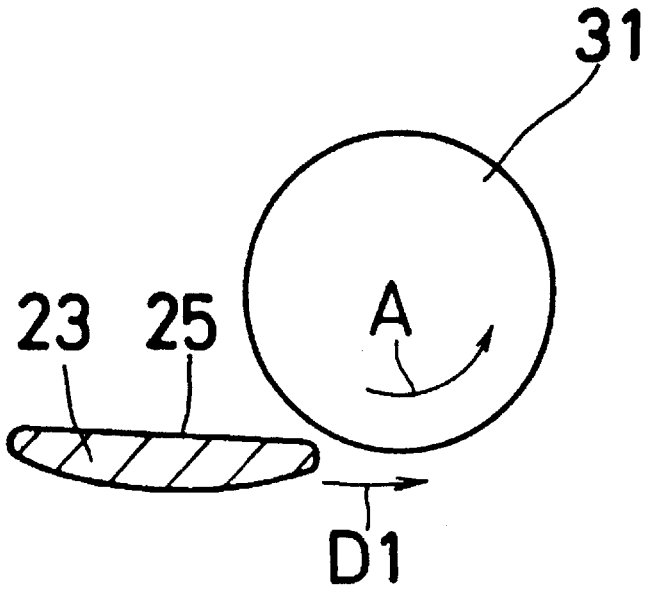
FIGS. 4A and 4B are views describing the movement of the ball 31 when the ball is hit.
Figure 4B:
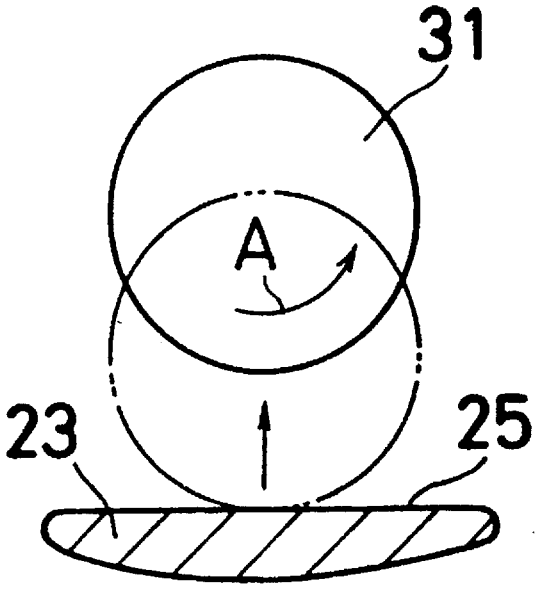

FIGS. 4A and 4B are views showing the ball 31 as the ball 31 which has dropped on the bottom ground 32, 32*a* of the low spot 30, 36 as shown in FIG. 3A, 3B is hit on high with the golf club 20. As shown in FIG. 4A, in order to loft up the ball 31 on the bottom ground surface 32, 32*a* over the elevating ground surfaces 33, 33*a* onto the ground surfaces 35, 37, the golf club 20 is operated in a hitting direction D1. As a result, the face 25 scoops up the ball 31 so that the ball 31 is popped up almost perpendicularly to the bottom ground surface 32 as shown in FIG. 4B.

When hit in this manner, the ball 31 is spun in the direction shown by an arrow A because of the grooves Hence, when the ball drops onto the ground surface 35, the ball will not move further forward (in the right direction of FIGS. 3A and 3B) from the landing point since inertia of the ball balances with spinning rotation force.

Even a professional golfer may hit a ball in a deep bunker ten times or more. Although to loft up the ball over a very tall tree was heretofore impossible, if the club according to the invention is used, it is possible to loft up the ball from the deep bunker and stop the hit ball at an aimed landing position in accordance with the same principle of a so-called "tempura (which means fry in Japanese)" phenomenon that the ball flies almost directly overhead when poorly shot with a driver. In short, this is the same as hitting a ball with the face open and the loft down in a deep bunker.

Figure 5:
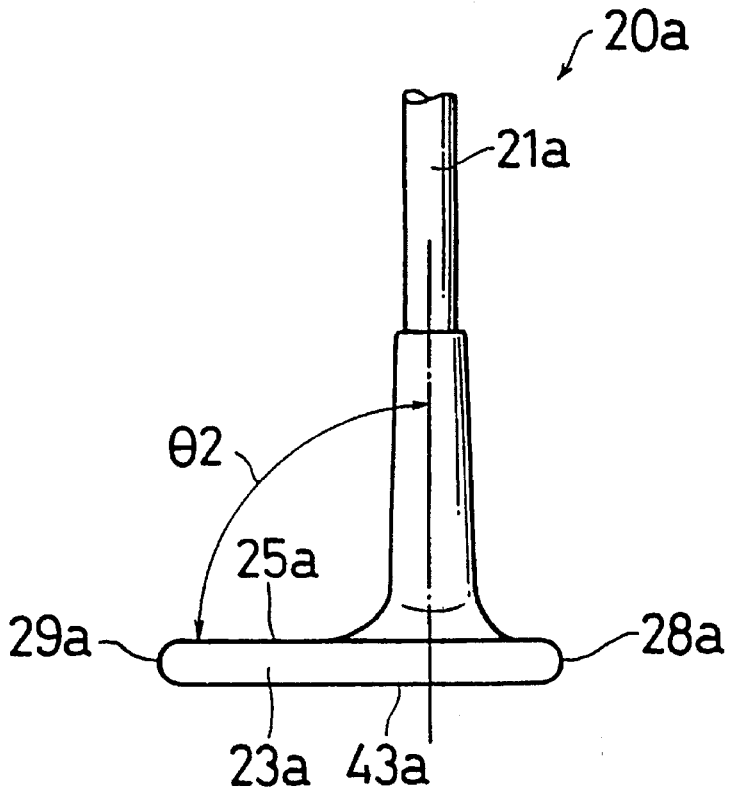
FIG. 5 is a side view of a golf club 20*a* of another embodiment of the invention.
Figure 6:
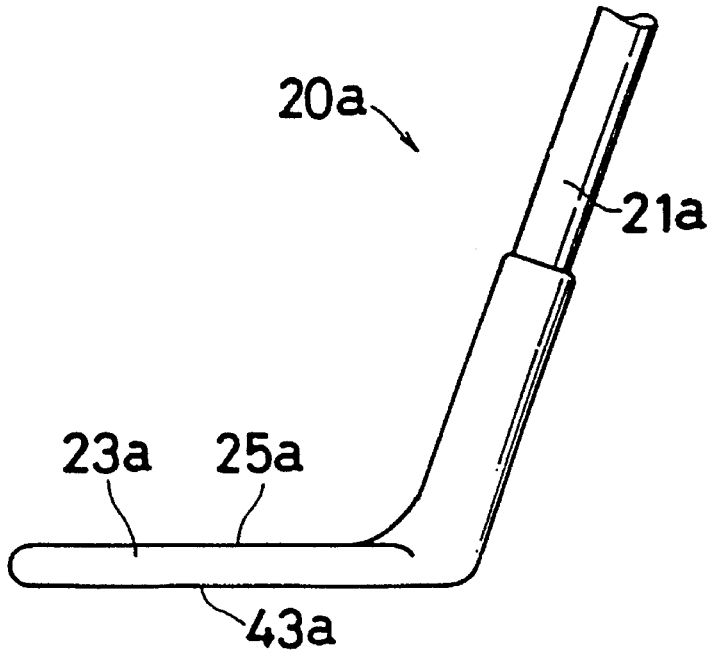
FIG. 6 is a front view of the golf club 20*a* of FIG. 5.

FIG. 5 is a side view of a golf club 20*a* of another embodiment of the invention and FIG. 6 is a front view of the golf club 20*a* of FIG. 5. A loft angle θ2 of the golf club 20*a* is 90 degrees and a head 23*a* has a back surface 43*a* almost parallel to a face 25*a*. Using such a golf club 20*a* , even if the ground is not a sand ground but a relatively hard ground as shown in FIG. 3B, it is not necessary to hit the head 23*a* into the bottom ground surface 32*a* as shown by the imaginary line 34*a* in FIG. 3B. Rather, by scooping up the ball 31 above the bottom ground surface 32*a*, it is possible to loft up the ball 31 almost perpendicularly to the almost horizontal bottom ground surface 32*a*.

Although such a head having a loft angle θ2=90 degrees is almost parallel to the ground, the thick portion renders lofting easy. In addition, it is possible to loft when the ball is hit in a hand-first style that hands are swing in advance of the head.

Figure 7:
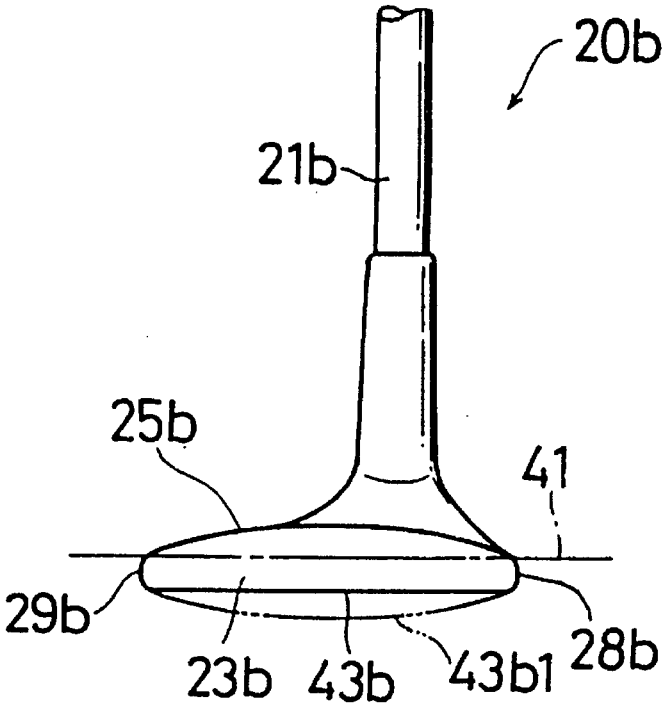
FIG. 7 is a side view of a golf club 20*b* of still another embodiment of the invention.
Figure 8:
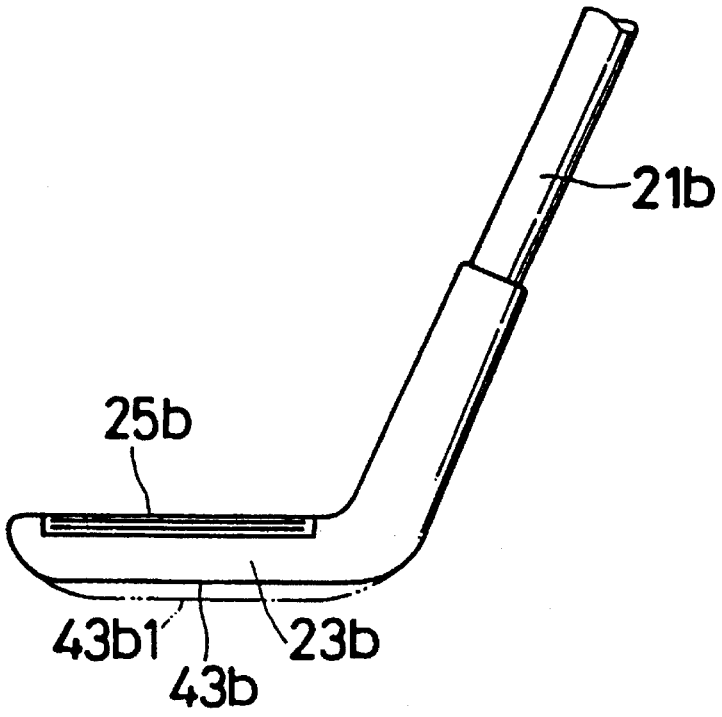
FIG. 8 is a front view of the golf club 20*b* of FIG. 7.

FIG. 7 is a side view of a golf club 20*b* of still another embodiment of the invention, and FIG. 8 is a front view of the golf club 20*b* of FIG. 7. While the faces 25, 25*a* of the golf clubs 20, 20*a* are shaped flat, a face 25*b* of the embodiment may be shaped like an arc with a bulge above a reference surface 41 as shown in the present embodiment. Alternatively, both the face 25*b* and a back surface 43*b*1 may have a bulge in the direction of the thickness as shown by an imaginary line.

Figure 9:
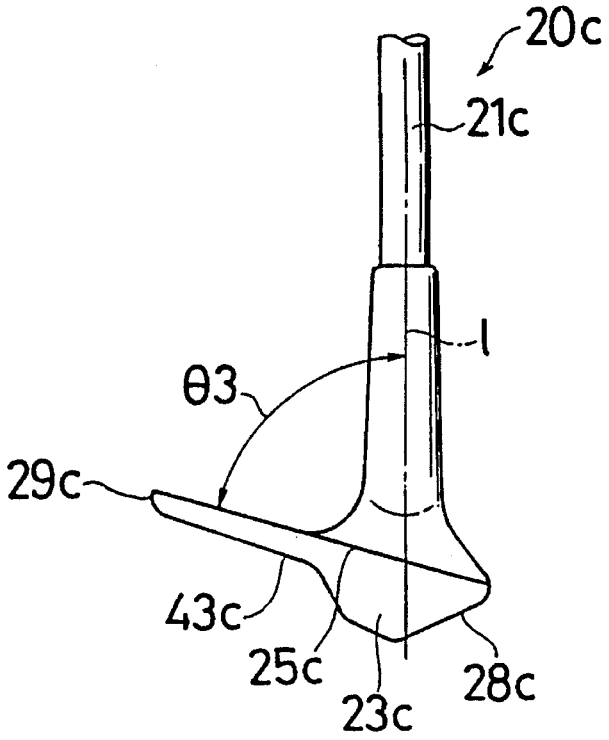
FIG. 9 is a side view of a golf club 20*c* of yet another embodiment of the invention.
Figure 10:
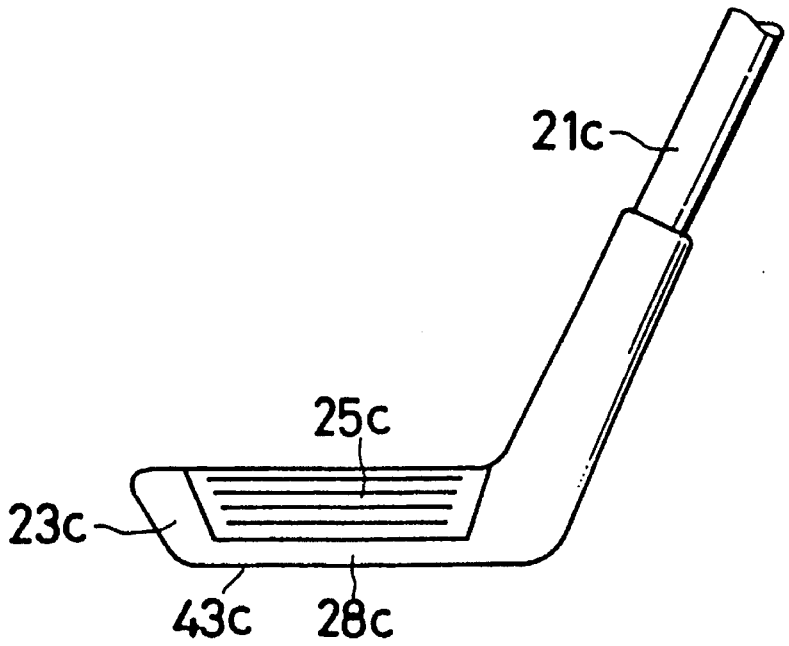
FIG. 10 is a front view of the golf club 20*c* of FIG. 9.

FIG. 9 is a side view of a golf club 20*c* of yet another embodiment of the invention, and FIG. 10 is a front view of the golf club 20*c* of FIG. 9. A loft angle θ3 of the golf club 20*c* is smaller than 90 degrees and since a back surface is at an angle of $\Theta_3$ within axis line 1 and the $\Theta_3$ angle is close to 90 degrees, the back surface 43*c* cross the axis line 1 nearly perpendicularly. Hence, when the ball 31 is hit, a lower portion of the ball 31 can be knocked with a head 23*c*, while the head 23*c* is guided almost in parallel to a ground surface 44. As a result, the ball 31 is easily scooped up onto the face 25*c* and hit in high almost perpendicularly to the ground.

Figure 11:
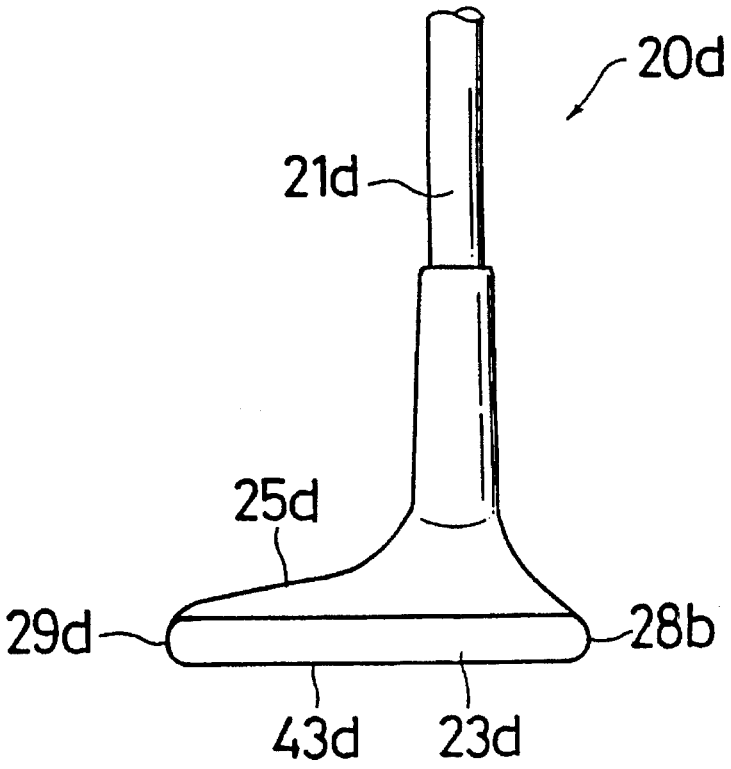
FIG. 11 is a side view of a golf club 20*d* of further embodiment of the invention.
Figure 12:
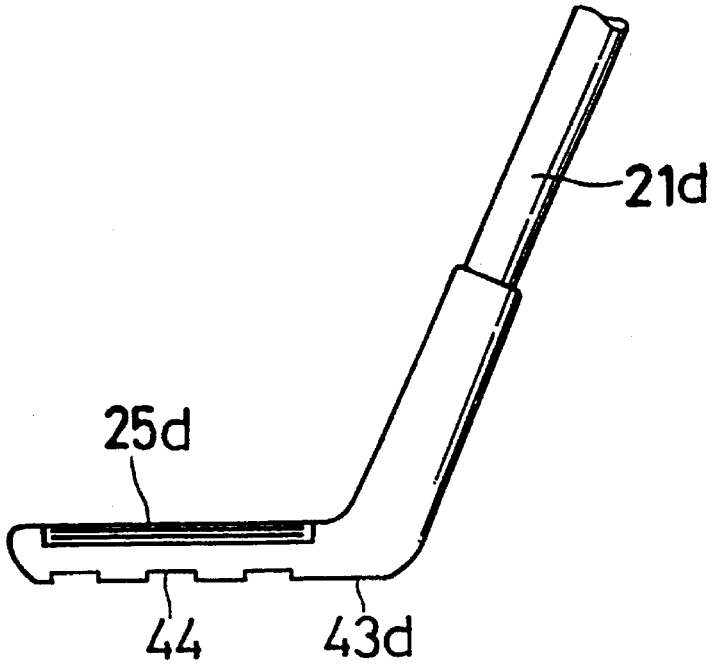
FIG. 12 is a front view of the golf club 20*d* of FIG. 11.
Figure 13:
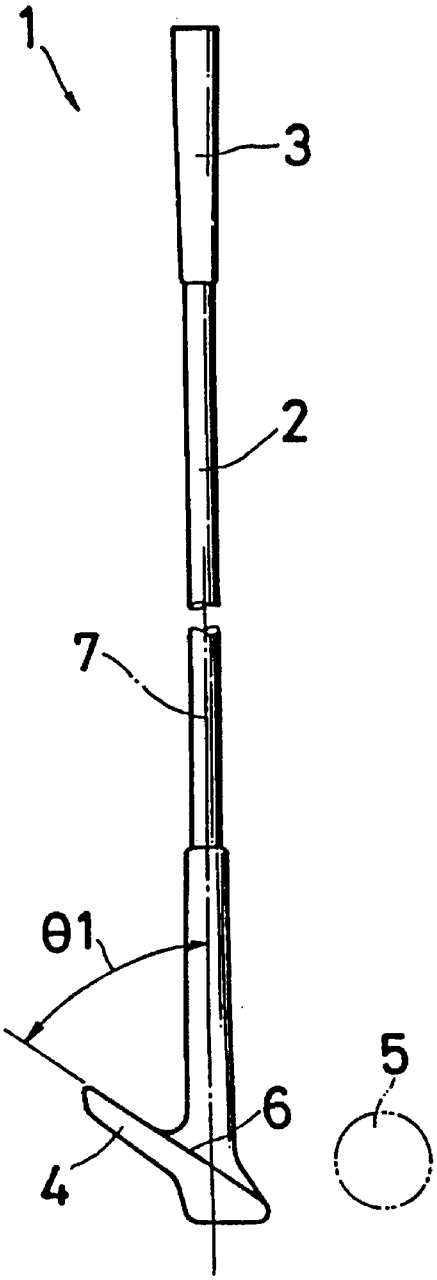
FIG. 13 is a side view showing a typical prior art.
Figure 14:
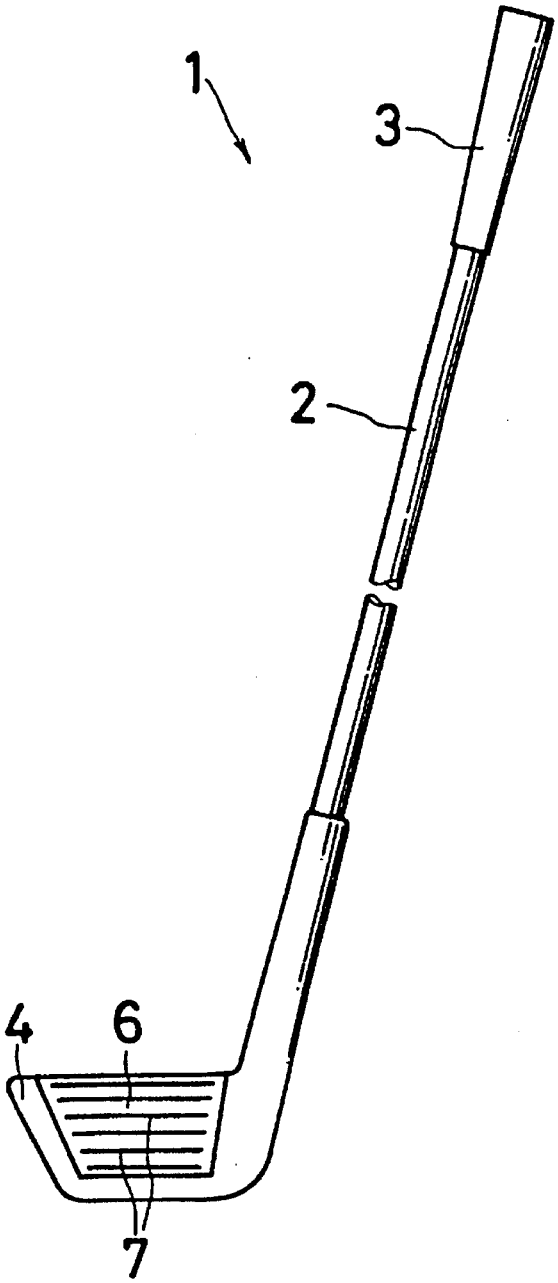
PRIOR ART FIG. 14
FIG. 14 is a front view showing the typical prior art of FIG. 13.

FIG. 11 is a side view of a golf club 20*d* of further embodiment of the invention, and FIG. 12 is a front view of the golf club 20*d* of FIG. 11. Grooves 44 are formed in the back surface 43*d* in the transverse direction thereof. When the ball 31 on a sand ground is hit, sand falls off through the grooves 44 of the back surface 43*d*, and thereby the force applied onto the golf club 20*d* can be used only for hitting the ball.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A golf club comprising a head including a face having a loft angle of 70 to 90 degrees and wherein the back surface of the head is shaped with a bulge.

* * * * *